US011772851B2

(12) United States Patent
Wieland

(10) Patent No.: US 11,772,851 B2
(45) Date of Patent: Oct. 3, 2023

(54) LIQUID APPLICATOR

(71) Applicant: Sulzer Mixpac AG, Haag (CH)

(72) Inventor: Christian Wieland, Malans (CH)

(73) Assignee: MEDMIX SWITZERLAND AG, Haag (CH)

( * ) Notice: Subject to any disclaimer, the term of this patent is extended or adjusted under 35 U.S.C. 154(b) by 0 days.

(21) Appl. No.: 17/352,643

(22) Filed: Jun. 21, 2021

(65) Prior Publication Data

US 2022/0402660 A1 Dec. 22, 2022

(51) Int. Cl.
*B65D 41/28* (2006.01)
*A45D 34/04* (2006.01)
*B65D 41/04* (2006.01)

(52) U.S. Cl.
CPC ..... *B65D 41/28* (2013.01); *A45D 34/042* (2013.01); *B65D 41/0414* (2013.01)

(58) Field of Classification Search
CPC .... B65D 41/28; B65D 41/0414; A45D 34/04; A45D 34/042; A45D 34/045; A45D 19/026; A45D 19/028; A45D 24/22; A45D 24/26; A45D 220/055–056; A45D 2034/005; A45D 37/00
USPC ..... 215/247; 401/285, 291, 282, 286–287; 132/320, 112, 116, 313–314, 317–318, 132/74.5; 206/581, 219, 229, 277, 823; 15/207.2
See application file for complete search history.

(56) References Cited

U.S. PATENT DOCUMENTS 1,525,955 A * 2/1925 Sanders ..... A45D 24/26 132/901
2,291,282 A * 7/1942 Hollenbeck ..... A46B 11/0024 401/152
2,411,435 A * 11/1946 Kirschenbaum ..... B65D 47/18 222/421
2,673,362 A * 3/1954 Robinson ..... A45D 34/042 401/202
2,782,438 A * 2/1957 Wittnebert ..... A46B 11/0013 401/269

(Continued)

FOREIGN PATENT DOCUMENTS

AU 2016374024 A1 6/2018
CN 108557237 U 9/2018

(Continued)

OTHER PUBLICATIONS

Extended European Search Report dated Jan. 13, 2021 in corresponding European Patent Application 20177965.9.

*Primary Examiner* — J. Gregory Pickett
*Assistant Examiner* — Brijesh V. Patel
(74) *Attorney, Agent, or Firm* — GLOBAL IP COUNSELORS, LLP

(57) ABSTRACT

A cap for an applicator includes an inlet, a base having a connection portion embodied for connecting the cap to the applicator or a container formed therein, a head that receives an application part of the applicator within the head, and a projection formed at a top part of the cap. The top part formed at an opposite end to the inlet, and the projection cooperating with an outlet of the applicator. The head includes a cylindrical or conical inner or outer shape and the connection portion has a round inner or outer shape, that is an oval, round or square shape.

18 Claims, 7 Drawing Sheets

(56) References Cited

U.S. PATENT DOCUMENTS 2,932,046 A * 4/1960 Skolnikoff ..... A45D 34/043 401/269
2,945,252 A * 7/1960 Martinean, Jr. ..... A45D 34/043 401/116
2,994,897 A 8/1961 Snable
3,090,070 A * 5/1963 Simons ..... A46B 11/0041 222/215
3,400,997 A * 9/1968 Schwartzman ..... B65D 47/42 401/265
3,454,196 A * 7/1969 Hazard ..... B65D 51/222 D9/449
3,592,202 A * 7/1971 Jones ..... A45D 34/042 401/269
3,655,290 A * 4/1972 Griffith ..... A45D 34/042 401/186
3,915,577 A * 10/1975 Cropton ..... A46B 11/0041 401/270
3,937,364 A * 2/1976 Wright ..... B05B 11/043 222/211
3,963,150 A * 6/1976 Steiman ..... B05B 11/047 222/211
3,985,271 A * 10/1976 Gardner ..... B05B 11/0059 222/211
4,040,753 A * 8/1977 Griffith ..... A45D 34/042 401/186
4,090,647 A * 5/1978 Dunning ..... G01F 11/082 401/262
4,279,527 A * 7/1981 Moe ..... A45D 34/042 401/277
4,370,989 A * 2/1983 Taylor ..... A45D 34/042 401/268
4,447,169 A * 5/1984 Vartoughian ..... A46B 17/04 401/269
4,726,386 A * 2/1988 Schultz ..... A45D 34/042 401/277
4,748,990 A * 6/1988 Brown ..... A45D 34/042 401/277
4,780,017 A * 10/1988 Bradford ..... A45D 34/045 401/128
4,838,722 A * 6/1989 Katz ..... B05C 17/005 401/101
4,846,201 A * 7/1989 Fuchs ..... A46B 11/0041 132/212
4,854,482 A 8/1989 Bergner
4,859,105 A * 8/1989 Davis ..... A45D 19/026 401/286
4,902,152 A 2/1990 Seidler
4,966,175 A * 10/1990 Kimura ..... A45D 34/042 401/278
4,993,437 A * 2/1991 Kimura ..... A61F 9/0008 401/262
5,052,589 A * 10/1991 O'Meara ..... B67B 7/24 215/257
5,066,157 A * 11/1991 Liff ..... A46B 11/0072 401/277
5,131,774 A * 7/1992 Katz ..... A45D 34/043 401/101
5,137,178 A * 8/1992 Stokes ..... B65D 35/22 D9/695
5,271,513 A * 12/1993 Crosnier ..... B05B 11/1073 401/277
5,388,728 A * 2/1995 Gueret ..... B65D 47/123 222/105
5,397,195 A * 3/1995 Goncalves ..... A45D 34/043 401/116
5,464,122 A * 11/1995 Lifshey ..... B65D 47/123 222/105
D366,151 S * 1/1996 Norris ..... D4/114
5,501,370 A * 3/1996 Okamura ..... B65D 47/123 222/105
5,590,798 A * 1/1997 O'Connell ..... B65D 51/222 215/253
5,593,066 A 1/1997 Konuma et al.
5,641,233 A * 6/1997 Wilson ..... A46B 11/0041 401/277
5,650,180 A 7/1997 Kumada et al.
5,720,563 A * 2/1998 Nakagawa ..... A45D 34/045 401/15
5,762,077 A * 6/1998 Griffiths, Jr. ..... A45D 24/22 132/116
5,857,796 A * 1/1999 Waldmann ..... A45D 34/042 401/277
5,904,433 A * 5/1999 Kay ..... A46B 17/04 401/269
5,919,360 A 7/1999 Contaxis, III et al.
5,934,457 A * 8/1999 Ueda ..... B65D 77/0493 215/250
6,161,978 A * 12/2000 Dovellos ..... A45D 24/22 132/116
6,260,557 B1 * 7/2001 Yarbrough ..... B65D 35/28 222/103
6,293,431 B1 * 9/2001 Seymour ..... B65D 35/28 222/103
6,311,871 B1 11/2001 Binder
6,315,165 B1 * 11/2001 Regan ..... B65D 35/28 222/103
6,315,483 B1 * 11/2001 Velliquette ..... B65D 35/28 222/103
6,662,973 B1 * 12/2003 Velliquette ..... B65D 47/2056 222/207
6,675,812 B1 * 1/2004 Wiley ..... B65D 47/243 132/139
6,688,314 B1 * 2/2004 Hoeffkes ..... A45D 19/026 132/114
6,736,290 B2 5/2004 Ichikawa et al.
6,851,577 B2 2/2005 Kleyman et al.
6,905,277 B2 * 6/2005 Saito ..... B43M 11/06 401/281
6,971,787 B2 12/2005 Botrie et al.
7,040,508 B2 5/2006 Woersdoerfer et al.
7,140,797 B2 11/2006 Hunter et al.
7,281,876 B2 * 10/2007 Kwon ..... B65D 47/42 401/265
7,364,054 B2 4/2008 Klein
7,377,711 B2 * 5/2008 Byun ..... A46B 11/0089 401/269
7,425,102 B1 9/2008 Velliquette
7,435,027 B2 * 10/2008 Hetzel ..... B65D 35/22 401/47
7,438,704 B1 * 10/2008 Kawashima ..... B65B 3/022 215/381
7,445,135 B2 11/2008 Miyata et al.
7,503,909 B2 * 3/2009 Kusu ..... A61F 9/0008 604/298
7,854,352 B2 * 12/2010 Davies ..... B05B 11/0032 128/203.14
8,028,859 B2 10/2011 Paetow et al.
8,056,748 B2 * 11/2011 Chen ..... B65D 51/225 215/334
8,075,215 B2 * 12/2011 Albisetti ..... A45D 34/042 401/282
8,147,461 B2 * 4/2012 Bonney ..... B05B 11/3052 604/246
8,162,161 B2 * 4/2012 Suzuki ..... B65D 51/225 215/334
8,201,566 B2 6/2012 Dumler et al.
8,220,668 B2 7/2012 Cadden et al.
8,313,006 B2 11/2012 Willner et al.
8,328,047 B2 12/2012 Walters et al.
8,425,474 B2 * 4/2013 Glassman ..... A61M 31/00 206/530
8,544,683 B2 10/2013 Springhorn et al.
9,005,178 B2 4/2015 Knee et al.
9,061,293 B2 6/2015 Beaulieu
9,205,970 B2 12/2015 Rahm et al.
9,211,995 B2 12/2015 Werner et al.
9,215,921 B2 * 12/2015 Thiebaut ..... A45D 40/26
9,238,544 B2 1/2016 Schulz et al.
9,334,088 B2 5/2016 Robinson et al.

(56) References Cited

U.S. PATENT DOCUMENTS

| | | | | |
|---|---|---|---|---|
| 9,481,495 | B2 | 11/2016 | Bellmore et al. | |
| 9,504,304 | B2 * | 11/2016 | Katz | A45D 40/20 |
| 9,517,488 | B2 | 12/2016 | Frey | |
| 9,517,863 | B2 | 12/2016 | Robinson et al. | |
| 9,527,106 | B2 | 12/2016 | Ngu et al. | |
| 9,579,686 | B2 | 2/2017 | Springhorn | |
| 9,731,258 | B2 | 8/2017 | Janssen et al. | |
| 9,968,959 | B2 | 5/2018 | Frey | |
| 10,099,239 | B2 * | 10/2018 | Tanrikulu | B05C 17/00 |
| 10,166,570 | B1 | 1/2019 | Lee et al. | |
| 2001/0027796 | A1 * | 10/2001 | Bouix | A45D 40/0087 132/318 |
| 2003/0041869 | A1 * | 3/2003 | Dovergne | A45D 24/22 132/116 |
| 2004/0047676 | A1 * | 3/2004 | Dumler | B43M 11/06 401/281 |
| 2005/0066987 | A1 * | 3/2005 | Perlman | B43M 11/06 401/281 |
| 2005/0072442 | A1 * | 4/2005 | Licari | B43M 11/06 401/281 |
| 2005/0169696 | A1 | 8/2005 | Albisetti | |
| 2005/0184091 | A1 * | 8/2005 | Abergel | B65D 81/3288 222/145.5 |
| 2006/0207627 | A1 * | 9/2006 | Thorpe | B65D 47/42 401/265 |
| 2007/0186950 | A1 | 8/2007 | Roeder | |
| 2007/0251537 | A1 | 11/2007 | de Laforcade | |
| 2008/0286034 | A1 * | 11/2008 | Chu | A45D 34/042 401/268 |
| 2009/0162132 | A1 | 6/2009 | Veasey et al. | |
| 2009/0277926 | A1 | 11/2009 | Schell | |
| 2010/0108709 | A1 | 5/2010 | Frey | |
| 2011/0049189 | A1 | 3/2011 | Strobel-Schmidt et al. | |
| 2011/0293354 | A1 * | 12/2011 | Dwyer | A45D 34/042 401/176 |
| 2014/0037364 | A1 | 2/2014 | Karl Hartstock et al. | |
| 2014/0257208 | A1 | 9/2014 | Ueta et al. | |
| 2017/0327299 | A1 | 11/2017 | Buck | |
| 2018/0000225 | A1 * | 1/2018 | Liu | A45D 34/042 |
| 2018/0056324 | A1 | 3/2018 | Springhorn | |
| 2018/0257836 | A1 | 9/2018 | McGuire et al. | |
| 2018/0305108 | A1 | 10/2018 | Foerg et al. | |
| 2018/0319567 | A1 | 11/2018 | Miller et al. | |
| 2019/0015865 | A1 | 1/2019 | Ludwig et al. | |
| 2019/0077563 | A1 | 3/2019 | Roesler et al. | |
| 2020/0031564 | A1 | 1/2020 | Nakahashi et al. | |
| 2020/0114569 | A1 | 4/2020 | Baumann et al. | |
| 2021/0221598 | A1 | 7/2021 | Paetow et al. | |

FOREIGN PATENT DOCUMENTS

| | | | | |
|---|---|---|---|---|
| CN | 208264952 | U | 12/2018 | |
| CN | 109393711 | A | 3/2019 | |
| CN | 109398951 | A | 3/2019 | |
| CN | 109436550 | A | 3/2019 | |
| CN | 109625574 | A | 4/2019 | |
| CN | 208683433 | U | 4/2019 | |
| CN | 209185851 | U | 8/2019 | |
| DE | 32 02 072 | A1 | 8/1983 | |
| DE | 10 2009 034 785 | A1 | 1/2011 | |
| DE | 20 2010 015 914 | A1 | 2/2012 | |
| DE | 10 2011 075 873 | A1 | 11/2012 | |
| DE | 20 2013 103 578 | U1 | 11/2014 | |
| DE | 20 2013 011 647 | U1 | 3/2015 | |
| DE | 20 2014 104 781 | U1 | 1/2016 | |
| DE | 20 2017 002 628 | U1 | 8/2018 | |
| DE | 10 2018 121 459 | A1 | 3/2019 | |
| EP | 1 266 844 | B1 | 1/2007 | |
| EP | 1 284 163 | B1 | 3/2008 | |
| EP | 1 992 251 | A1 | 11/2008 | |
| EP | 2288556 | A1 | 3/2011 | |
| EP | 2 730 310 | A1 | 5/2014 | |
| EP | 3 013 704 | A1 | 12/2014 | |
| EP | 3 162 733 | A1 | 5/2017 | |
| EP | 3 188 903 | A2 | 7/2017 | |
| EP | 3 195 941 | A1 | 7/2017 | |
| EP | 3 199 248 | A1 | 8/2017 | |
| EP | 3 272 372 | A1 | 1/2018 | |
| EP | 3 309 093 | A1 | 4/2018 | |
| EP | 2 670 278 | B1 | 6/2018 | |
| EP | 3 368 435 | A1 | 9/2018 | |
| EP | 3 372 372 | A1 | 9/2018 | |
| EP | 3 385 192 | A1 | 10/2018 | |
| EP | 2 063 926 | B1 | 8/2021 | |
| FR | 2800041 | A1 * | 4/2001 | A45D 34/04 |
| GB | 2482212 | A | 1/2012 | |
| JP | 6017888 | B2 | 11/2016 | |
| JP | 6183796 | B2 | 8/2017 | |
| JP | 6193442 | B2 | 9/2017 | |
| JP | 2017158939 | A | 9/2017 | |
| JP | 2019115889 | A | 7/2019 | |
| WO | 2018/162217 | A1 | 9/2018 | |
| WO | 2018/184820 | A1 | 10/2018 | |
| WO | 2018/235519 | A1 | 12/2018 | |
| WO | 2019/073337 | A1 | 4/2019 | |

* cited by examiner

Detail B
10:1

LIQUID APPLICATOR

BACKGROUND

Field of the Invention

The present invention relates to an improved cap for an applicator, in particular a bristle applicator, as well as to an assembly comprising the cap and optionally a metering device and/or a button and/or a sachet.

Background Information

Conventional caps for applicators are known from the disclosure of DE202014104781U1 (DE'781), which describes a closure (or a cap) for a bristle applicator that is economical and accurate for application of a cosmetic and/or pharmaceutical substance while maintaining hygienic conditions. As disclosed by the document this benefit was achieved by providing the neck portion of the applicator with a tapered outer shape or form of the closure of the closure cap, which is designed to center the closure cap before its projection reaches the mouth begins to penetrate into the bristles.

SUMMARY

Although the closure of DE'781 provides the above described benefit, it has been determined that unfortunately it can damage the bristles over course of use due to frequent undesirable contact between the bristles and the projection (spike) in the cap.

Therefore, it is desirable to provide an improved solution that closes the container and does not damage the bristles of the applicator. Furthermore it is desirable to have a solution that can be applied to applicators having a variety of neck shapes and geometries and not just tapered ones. In addition, it is desirable to have an assembly designed in a way that is suitable for single as well as multi-use applications of the applicator and not only the cap, while keeping in focus the pharmaceutical needs of maintaining hygienic conditions. It is noted that metered dosing is also critical in pharmaceutical applications. The disclosure of DE'781 does not teach one how to achieve the above-mentioned objectives.

Starting from this state of the art, it is an object of embodiments of the the present invention to provide an improved cap for an applicator, in particular a bristle applicator, and most particularly one that solves the problem of avoiding bristle damage during repeated open and closure. It is desirable that caps have an inlet, a base having a connection portion embodied for connecting the cap to the applicator and/or a container, and a head configured to receive an application part of the applicator within the head, and a projection formed at a top part of the cap, the top part being formed at an opposite end to the inlet and the projection being configured to cooperate with an outlet of the applicator, for example, by sealing the outlet.

According to embodiments of the invention, these objects are achieved by providing a cap having a head that has at least one of a substantially cylindrical or conical inner and/or outer shape and a connection portion with a substantially round inner and/or outer shape, a substantially oval and square inner and/or outer shape. This special geometry guides the bristles such that they are centrally aligned before they reach a projection of the cap. The geometry results in the combined benefits of closing the applicator system tightly with the help of the projection and providing a safe guidance to the delicate bristles during closing.

DE'781 does not disclose this special geometry of embodiments of the present invention. Also, it is silent about the problem of damage to the bristles and solutions of how to minimize such damage. Instead, the prior art focuses on the problem of how to better seal the outlet, and it proposes a way to improve the sealing by centering the cap by providing a conical outer shape of the applicator. This disclosed solution does not provide guidance as to how to arrive at the solution of the embodiments of the present invention in which the inventive cap is designed to center itself, irrespective of the geometry of the applicator.

In some embodiments, the connection portion has a substantially round inner and outer shape and is preferably combined with a head that has at least one of a substantially conical outer shape and a conical inner shape, alternatively combined with a head that has at least one of a substantially conical outer shape and a cylindrical inner shape, a head that has at least one of a substantially cylindrical outer shape and a conical inner shape, or a head that has at least one of a substantially cylindrical outer shape and a cylindrical inner shape.

In another embodiment the head that has at least one of a substantially conical outer shape and a cylindrical inner shape and the connection portion has a substantially oval inner and outer shape.

The shape alternatives mentioned above provide the same benefit and the geometries are well suited for manufacturing the cap in any standard manufacturing process.

In one embodiment of the present invention the cap comprises an alignment portion and a fitting portion. The alignment portion, present as part of the head of the cap, aligns the applicator, particularly the bristles of the applicator, substantially in parallel to a longitudinal axis of the cap. In a more specific embodiment, the alignment portion is preferably cylindrical in shape and/or has a length that is about 20% to about 40% of the length of the head. This geometry and length facilitates that the bristles are centered before they reach the projection so that the projection safely passes through the bristles and seals the applicator without damaging the bristles. The alignment portion guides the applicator to ensure the precise centering of the applicator bristles. In the absence of a good guidance, the delicate bristles may get damaged or fall off due to frequent contact with the different parts of the cap. Also, if not centered precisely, the projection of the cap may destroy the fine bristles permanently, rendering the applicator useless.

The fitting portion, also present as part of the head of the cap, allows the applicator to be detachably fitted inside the cap, such that the cap can house the applicator without letting it fall off. This has two unexpected benefits, one being that, as the applicator is fitted detachably, it cannot be easily displaced by a tangential force which is less than a predetermined amount. Hence the cap stays in its position without being displaced, which could otherwise damage the bristles. Secondly, the applicator can be first fitted inside the cap, and then this combined assembly of cap and applicator can be attached to the container. This combined assembly can be useful especially in cases when the applicator needs to be replaced after single use. Hence, the user could replace this combined unit of cap and applicator on the container after every use. This aspect is particularly critical when the applicator should not be exposed to the environment before use, for example, to maintain its sterility.

In a specific embodiment the fitting portion comprises at least one change in inner radius of the head. In an even more specific embodiment, there is a reduction of the inner radius of the head, preferably by means of one or more protrusions, preferably ridges, or a conical geometry or a change from a larger cylindrical diameter to a smaller cylindrical diameter. These unique geometries allow the applicator to readily fit inside the cap and are inexpensive and easy to manufacture.

In one of the embodiments of the present invention, the cap is for single use applications while in another embodiment the cap is suitable for reusable applications.

The cap of embodiments of the present invention can be made of metal, glass or plastic. The most preferred material would be plastic as it has many advantages over the other materials, such as being light, inexpensive, easy to mould, and long lasting. In a preferred embodiment of the present invention, the cap is made of a thermoplastic, particularly polypropylene (PP). In another preferred embodiment of the present invention the cap is made of silicone; and/or a thermosetting resin. These plastics are suitable for use in different manufacturing techniques and are also inexpensive, light and durable.

In certain embodiments of the cap the connection portion may be a threaded, bayonet, snap-fit or a snap-on connection. These mechanisms for connection have been found to be best suited for connecting the two parts detachably. The connection portion connects the cap to the applicator and/or the container detachably.

The cap of embodiments the present invention has a projection at the top of the cap. In one embodiment of the invention, the projection preferably extends at least substantially parallel to a longitudinal axis of the cap, wherein the longitudinal axis of the cap extends through the base and the head, and a central axis of the head is arranged parallel to the longitudinal axis of the cap. As the application part (bristles) is parallel to the longitudinal axis, a parallel projection therefore minimizes any damage the applicator part.

However, if the application part is not parallel to the longitudinal axis, the projection can be inclined accordingly to pass through the application part without damaging it.

In specific embodiments of the invention, the projection comprises a body and a tip. The body part extends between the top of the cap and the tip. The body part is not specifically limited and can have one of a conical, a cylindrical, or a rectangular shape.

The projection has a tip disposed opposite to the top of the cap. The tip is not specifically limited and can have one of a truncated cone shape, a conical shape, a rounded shape, or a cylindrical shape, preferably a truncated cone shape. The shape and size of the tip is configured according to the shape ans size of the outlet of the applicator, to ensure perfect sealing of the applicator. Given the location of the tip and its size, these shapes are easy to fabricate and can effectively seal the outlet of the applicator.

The body and the tip can be made of the same or different materials. The body of the projection can advantageously be made up of material that is rigid so that it can provide mechanical stability to the projection and passes easily through the bristles. The tip, can be made of a rigid or a soft material, preferably soft. The tip can be preferably made of elastomer, preferably silicone, which is a soft elastomer. This softness will help the tip to securely seal the outlet of the applicator.

In certain embodiments of the invention, the inner diameter of the cap undergoes changes in size between the top and the connection portion. These changes can be continuous or discontinuous. The inner diameter of the cap can increase from the top of the cap till the connection portion of the cap, and the increase can be by about 30%. The diameter of the applicator generally increases from its top, where the application part is located, till its neck. This change in diameter of the cap is configured such that it holds the applicator firmly and eliminates the empty volume at the top by having a smaller diameter at its top.

The cap of embodiments of the present invention can have multiple outer surfaces, including that at its top, head, the transition from the head to the base, and its base. The outer surfaces each can have different shapes. For example, the head and base can either be conical or cylindrical in shape. In a preferred embodiment the outer shape at a transition from the head to the base is conical, which allows the cap to have a constant wall thickness and can also allow better manufacturability.

The cap of the present invention has at least one inlet for allowing the applicator, particularly the application part (bristles) and neck, to enter the cap for closure. The inlet can have a rounded or preferably a conical surface. When the cap is closed, the bottom of the base touches the container. If the surface is conical at the beginning of the inlet, it allows the cap to sit on the container in a manner which does not leave room for dust or particles to accumulate between the inlet and the container. Also, a conical geometry is more desirable than a pure cylindrical geometry at the inlet. A conical geometry provides a better fitting that will not allow the cap and the container to rub against each other causing friction, and thus the cap will not leave any friction marks on the container after being used multiple times on closing tightly.

Another aspect of the present invention is an assembly comprising the cap, an applicator and a container.

The applicator of embodiments of the present invention comprises an application part, outlet, neck and a connection base. In certain embodiments of the invention the application part of the applicator is a foam applicator, a massage surface, a plain surface, flock, or bristles, preferably bristles. The applicator, excluding the application part, can be made of plastic, preferably High-Density Polyethylene (HDPE) or PP. These varieties of plastics are rigid when solid and can be easily molded into a desired shape. Also, they are relatively inexpensive, and thus these would be preferred materials to make the applicator (excluding the application part).

In still other more specific embodiments of the present invention, the application part of the applicator comprises micro-bristles. Micro-bristles are usually very fine and have a density of more than about 2 bristles per $mm^2$. These micro-bristles can be made of plastic, preferably polyethylene, more preferably Low-Density Polyethylene (LDPE). The application part will dispense the material onto a surface of the user's body and hence, needs to be soft and flexible for a desirable dispensing of the contents. Materials, such as LDPE, can be extruded into fine fibers that are soft and flexible, and hence, are suitable for making the application part of the applicator.

In a more specific embodiment of the present invention, the application part can have micro-bristles with a density of greater than or equal to about 3 bristles per $mm^2$. These fine bristles have a larger surface area (on the order of about 15 $mm^2$), as compared to normal bristles, and may hold larger volumes of fluid or dispense fluids more precisely. Thus, they allow the user to have a better control over the flow of the fluid.

In one embodiment of the present invention, the length of the application part is shorter than that of the alignment portion, so that the alignment portion guides the applicator part to center itself.

As one skilled in the art will appreciate that all of these above mentioned variations of the application part should be handled appropriately. The cap of embodiments of the present invention provides advantages over the prior art owing to its innovative shape, and the application part has an important role in dispensing the contents of the container.

Yet another aspect of the present invention is an assembly comprising the applicator, a container and the cap, wherein the container optionally holds a fluid for application. In some specific embodiments the fluid is a medication. In some more specific embodiments, the medication is a liquid for treatment of a symptom, injury or a disease, for example, present on a surface of the body, such as skin, eyes, or ears. In alternative embodiments, the fluid can be a cosmetic mass, such as a mascara.

The container can be made of plastic, metal or glass, preferably plastic. In a preferred embodiment, the container of the present invention is made of HDPE.

The cap, the applicator and the container of the present invention can be made using standard manufacturing processes such as injection, slush, compression, or blow moulding or alternatively by thermoforming, vacuum forming or casting.

In another embodiment of the present invention, the assembly comprises a metering device. This metering device allows the user to control the amount of fluid, contained in the container, that flows out through the outlet of the applicator. For example, the user could inadvertently deploy large quantities or the entire contents in the absence of a metering device, due to a misuse, or by pressing the container too hard. This undesirable situation is averted by providing a metering device. Thus the metering device ensures that the user will be able to dispense a controlled amount of contents from the container despite the application of a variable amount of force (by squeezing) to the container. To elaborate further, the metering device ensures that fluid emerges only "drop-by-drop" from the outlet, irrespective of the magnitude of force applied to dispense the fluid.

In still other more specific embodiments, the metering device has an inlet, an intermediate storage reservoir and an outlet, which are all in fluid communication with each other. Also, the inlet of the metering device is in fluid communication with the container of the applicator, and the outlet of the metering device is in fluid communication with the outlet of the applicator. The volume of the intermediate storage reservoir can be varied and thus the amount of fluid leaving the container can be controlled. Conventional methods to meter the dose include modifying the outlet of the applicator, particularly the orifice radius. However, it is difficult to consistently manufacture orifices with a constant radius. The inventors of the present invention have found a better solution to meter the dose, by providing a metering device. The metering device can be made from a plastic, preferably a thermoplastic, such as HDPE or PP.

In another embodiment, the assembly comprises a dosing device in the form of a button. The button is typically located on either the lateral surface of the container or the bottom of the container. The button generally protrudes out from the surface of the container and can be pressed. The shape of the button may be substantially circular or polygonal, preferably circular or polygonal and the size and protrusion volume may be varied in accordance with the quantity of fluid to be administered. The button is made up of a material that is soft, preferably an elastomer, more specifically thermoplastic elastomer (TPE). The button can be fabricated to fasten it on to the container with the help of an adhesive. Alternatively, the button can be manufactured together with the container by a hybrid extrusion or injection blow moulding or two component injection moulding process.

As the user will be only pressing the button, the force applied is restricted to the extent the button can be squeezed. This allows dosing of a determined amount of fluid to be dispensed and avoids wastage, which may have occurred in absence of such a dosing provision.

In another general embodiment, the assembly comprises a sachet, wherein the sachet holds a fluid for application, and wherein the sachet is inside the container, and is in fluid communication with the outlet of the applicator. The sachet can be made of soft material and is flexible. When pressure is applied on the container, the sachet is squeezed, and the fluid contained in the sachet will flow out. The sachet can be cylindrical or rectangular, or of any other suitable shape. The sachet generally has a single opening, through which the fluid is filled. This opening is in fluid communication with the outlet of the applicator, so that when the user applies pressure the fluid in the sachet is dispensed. The sachet can be made of single or multiple layers of plastic or metal or paper or fiber (laminate). The sachet can be produced separately and be attached to the container or the applicator before or after filling it with the fluid. Alternatively, the sachet can be produced while producing the container, by employing well known manufacturing techniques such as injection blow molding.

In specific embodiments the button can be combined with the metering device or the sachet. The button provides the user with a means of applying pressure to the container, in a convenient and precise manner. The assembly can dispense the material, after being pressed/squeezed by the force transferred onto it by way of the user pressing the button.

One skilled in the art will understand that the combination of the subject matters of the various claims and embodiments of the invention is possible without limitation in the invention to the extent that such combinations are technically feasible. In this combination, the subject matter of any one claim can be combined with the subject matter of one or more of the other claims. In this combination of subject matters, the subject matter of any one cap or assembly claim can be combined with the subject matter of one or more other cap or assembly claims. By way of example, the subject matter of any one claim can be combined with the subject matters of any number of the other claims without limitation to the extent that such combinations are technically feasible.

One skilled in the art will understand that the combination of the subject matters of the various embodiments of the invention is similarly possible without limitation in the invention. For example, the subject matter of one of the above-mentioned cap embodiments can be combined with the subject matter of one or more of the other above-mentioned assembly embodiments or vice versa without limitation so long as technically feasible.

BRIEF DESCRIPTION OF THE DRAWINGS

The invention will be explained in more detail hereinafter with reference to the drawings.

DETAILED DESCRIPTION

Definitions

As used in the specification and claims of this application, the following definitions, should be applied:

"a", "an", and "the" as an antecedent may refer to either the singular or plural unless the context indicates otherwise.

'soft' in the present application means a material is non-rigid and able to resume its normal (original) shape spontaneously after being stretched or compressed.

Geometric shapes and aspects refer to overall shapes and appearances and include shapes and aspects that do not substantially differ from the stated shape or aspect. For example, "round" therefore includes shapes that are substantially similar and differ only to a minor extent from a perfectly round shape, for example, due to tolerances and manufacturing constraints. Therefore "round" includes shapes which are substantially similar in function or capability to a round shape and/or which a person of ordinary skill in the art would consider to be substantially similar to a round shape.

Numerical values in the present application relate to average values. Furthermore, unless indicated to the contrary, the numerical values should be understood to include numerical values which are the same when reduced to the same number of significant figures and numerical values that differ from the stated value by less than the experimental error of the conventional measurement technique of the type described in the present application to determine the value.

Figure 1A:
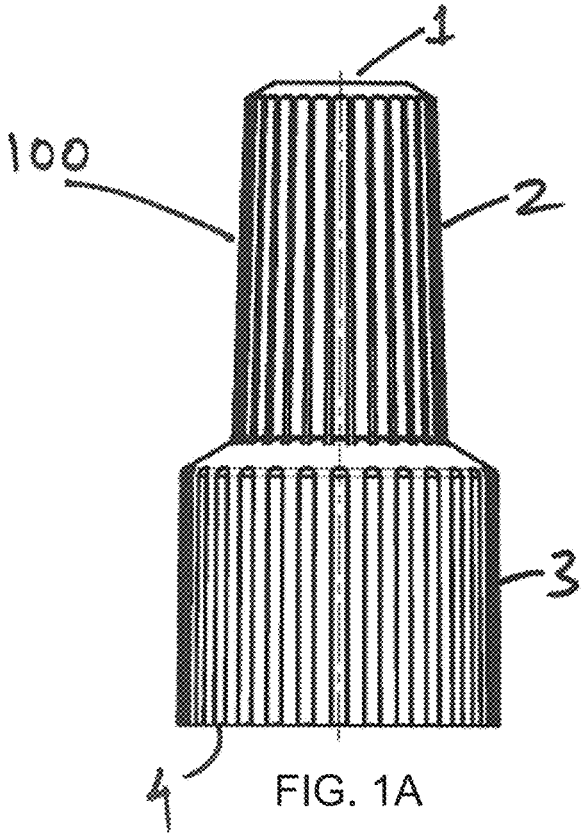
FIG. 1A shows a schematic view of a cap according to the invention.

FIG. 1A depicts a cap 100 according to the present invention. The cap 100 has a top 1, a head 2, a base 3 and an inlet 4. Even though, as depicted in FIG. 1A the outer surfaces of the head 2 and the base 3 of the cap 100 are irregular, they could also be smooth. There exists a conical surface between the head 2 of the cap 100 and its base 3 in this embodiment.

Figure 1B:
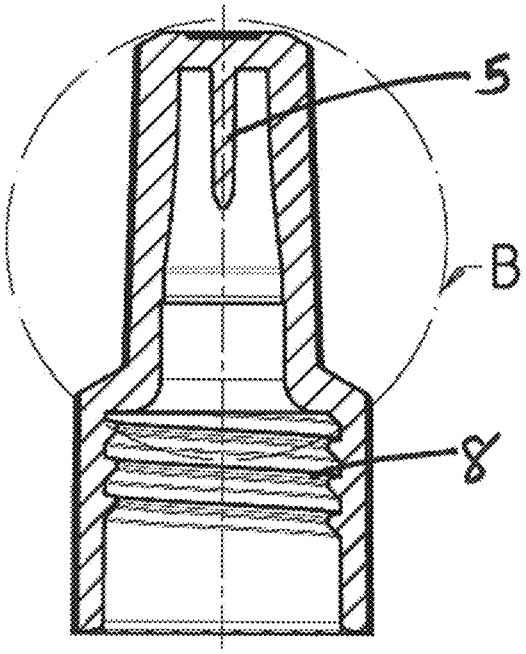
FIG. 1B shows a schematic view of a cross-section of the cap.

To explain the invention, the individual regions of the cap 100 will be initially defined below referring to FIG. 1B which shows a cross sectional view of the cap. As can be seen from the figure, the inner part of the head 2 of the cap 100 comprises a projection 5, a fitting portion 6 and an alignment portion 7. The inner surface of the cap 100 has a conical shape starting from the top 1 of the cap, till the fitting portion 6, the radius of the cone increasing from the top 1 to the fitting portion 6. The alignment portion 7 begins in the head 2 of the cap, preferably after the fitting portion 6 ends, and is cylindrical in shape. The alignment portion 7 extends into the area between the transition from the head 2 to the base 3 of the cap 100, and the alignment portion 7 may be followed by a smooth curvature as shown in FIG. 1. The smooth curvature allows the cap 100 to sit on the applicator 200 and directs the bristles of the applicator 200 smoothly into the alignment portion 7. The inner surface of the cap 100, where there is a transition from the head 2 to the base 3, could alternatively have a conical geometry. The base 3 of the cap 100 comprises a connection portion 8 and an inlet 4. The connection portion 8 as seen in FIG. 1B can connect the cap to the container 15 by threading. The connection portion 8 of embodiments of the present invention is not specifically limited and can include one of a thread or a bayonet connection or a snap fit connection or a snap-on connection. FIG. 1B shows that the bottom of the base 3, at the inlet 4, can have a conical inner surface.

Figure 1C:
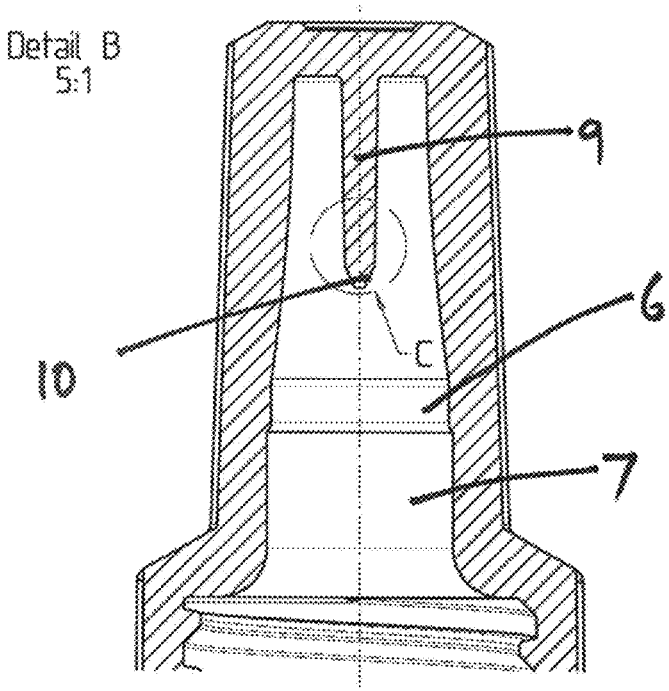
FIG. 1C shows a schematic view of a cross-section of the head of the cap.

FIG. 1C is an enlarged cross-sectional view of the head 2 of the cap. As seen from the figure, the projection 2 that extends from the top 1 of the cap 100 (and typically towards the inlet 4 and thus the entering applicator 200 and its application part or bristles 11) has a body 9 and a tip 10. The body 9 of the projection 5 can be cylindrical or conical, but it must generally be rigid. When the tip 10 seals the outlet 14 of the applicator 200, the body 9 of the projection 5 should not move or deform so as to prevent it from coming in contact with the bristles. The tip 10 can be rigid or soft, preferably soft, more preferably made of soft polymer, most preferably an elastomer or silicone. The head of the cap 100 further comprises a fitting portion 6 and alignment portion 7. The alignment portion 7 being preferably cylindrical, begins in the region at the transition between the head and the base of the cap. The fitting portion 6 lies above the alignment portion 7. As seen from the figure, there is a change in the inner radius of the cap 100 in the fitting portion 6. From the direction of bottom of the base to the top (from bottom to top), the fitting portion comprises an abrupt decrease in inner radius. There is a cylindrical inner surface between the two changes in radii of the fitting portion 6.

Figure 1D:
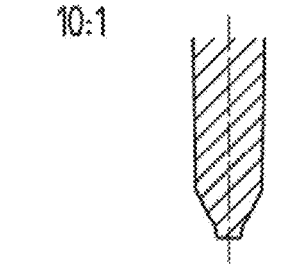
FIG. 1D shows a schematic view of a cross-section of the tip of projection of the cap.

FIG. 1D shows an enlarged cross-sectional view of the tip 10 of the projection. The tip 10 has a conical surface and preferably an additional cylindrical surface below the conical surface. The cylindrical surface, having a radius lesser than the outlet 14 of the applicator 200, will penetrate into the outlet 14 of the applicator, and seal it (Shown in FIG. 3B).

Figure 2A:
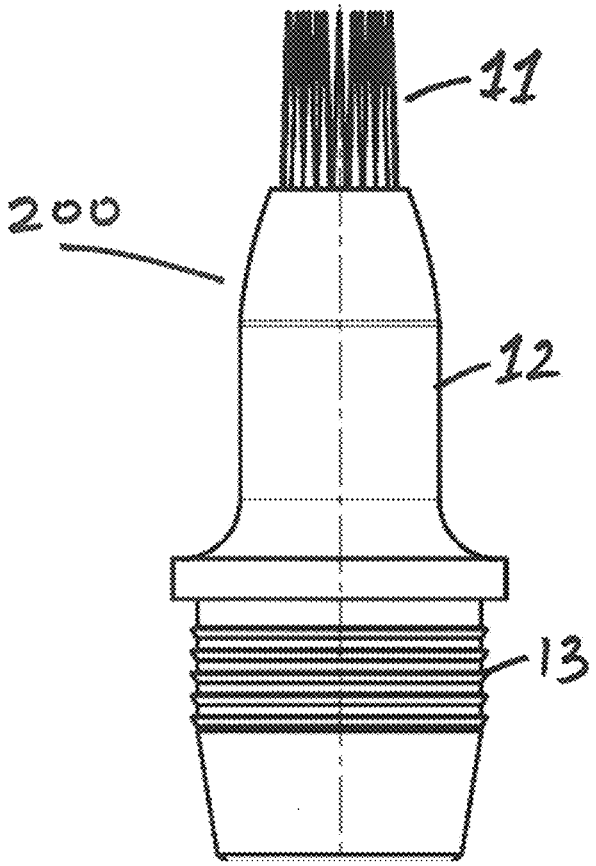
FIG. 2A shows a schematic view of an applicator comprising an applicator part and cylindrical neck.

FIG. 2A depicts a schematic view of the applicator 200. The applicator 200 comprises an application part 11, a neck 12, an outlet 14 and a connection base 13. As seen from the figure the outer surface of the neck 12 is preferably cylindrical. The outer radius of the applicator may form a smooth curve as it decreases from the neck 12 to the top of the applicator 200, as in this figure. In other embodiments the neck 12 may be conical, Codd-like, curved, with sloping shoulders, bulbous, wide, narrow, cylindrical, spout-like, candle-like, stepped, nozzle-like, fluted, have lips or various combinations of these so long as technically possible. One skilled in the art will understand that the shape and size of the cap 100 and its inlet 4, head 2 and various portions will correspondingly be selected to complement the shape of the applicator 200 and its neck 12.

Figure 2B:
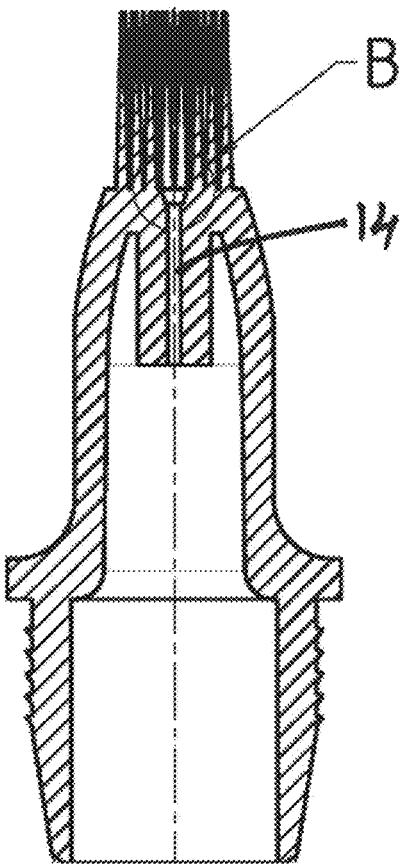
FIG. 2B shows a schematic view of a cross-section of the applicator having an outlet.

FIG. 2B shows a cross-sectional view of the applicator 200. It can be seen here that the outlet 14 begins from the bottom of the applicator 200 part and extends into the neck 12 of the applicator 200.

Figure 2C:
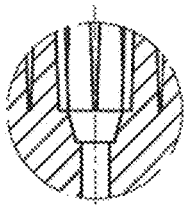
FIG. 2C shows a schematic view of a cross-section of the outlet of the applicator.

FIG. 2C shows an enlarged cross-sectional view of the tight point of the outlet 14 of the applicator 200. This tight point is the point at which the tip 10 of the projection 5 of the cap 100 seals the outlet 14 of the applicator 200.

Figure 3A:
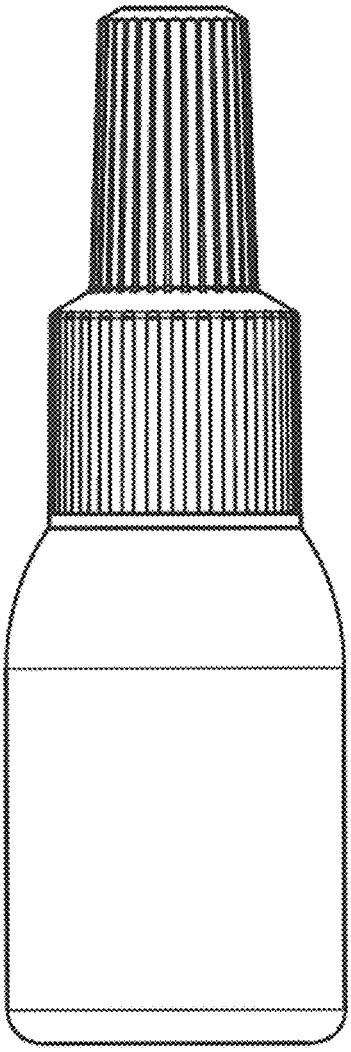
FIG. 3A shows a schematic view of an assembly comprising the cap, applicator and the container.

FIG. 3A depicts a schematic view of the assembly 300 comprising the cap, applicator 200 and the container. The size of the container shown in the figure can be scaled up or down as per requirement.

Figure 3B:
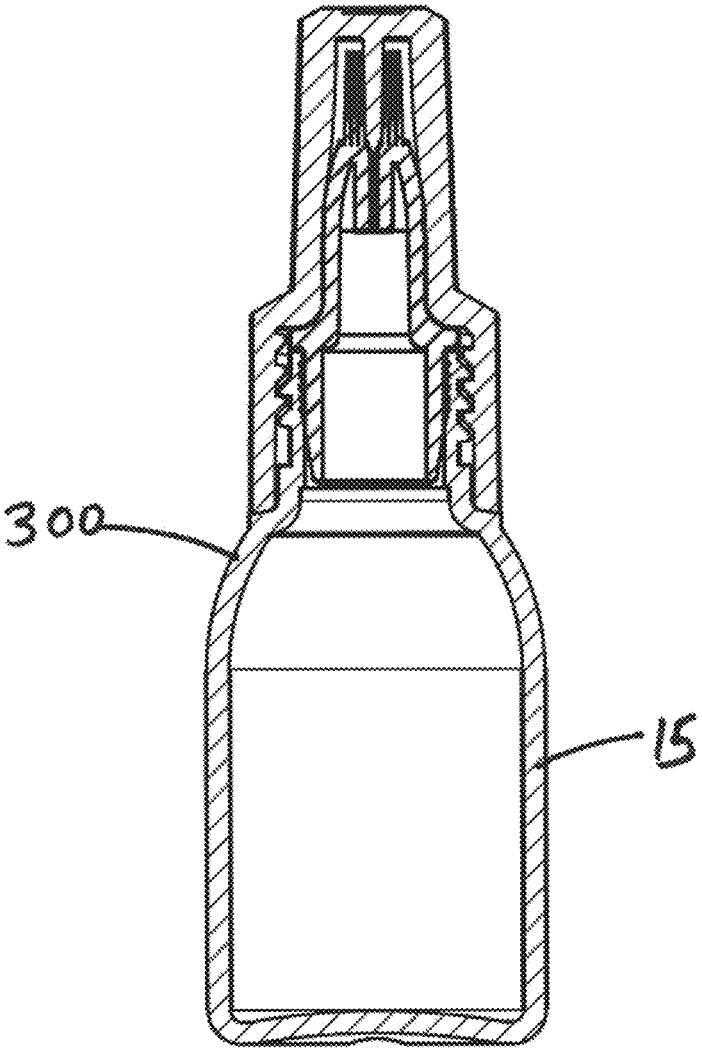
FIG. 3B shows a schematic view of a cross-section of the assembly comprising the cap, applicator and the container.

FIG. 3B shows a cross sectional view of the assembly 300 according to an embodiment of the present invention. As can be seen from the figure, the cap 100 of this embodiment of the present invention seals the outlet 14 of the applicator 200 while its bristles are accurately centered to allow the projection 5 of the cap 100 to penetrate without damaging the bristles. It can be seen that the projection 5 is configured to cooperate with the outlet 14 of the applicator 200. For example, the projection 5 seals the outlet 14 by contacting the surface of the outlet 14 to form a seal in this figure. One skilled in the art will understand that other cooperation mechanisms are possible, for example, the projection 5 can inter-lock with, or penetrate into the outlet 14. The head 2 is shown here to have an inner cavity which has a shape and/or diameter suitable for allowing a pre-determined portion of the application part 11 and the neck 12 to enter the head 2 and be covered and protected by it. This figure thus shows an example of how complementary shapes can be selected and used for the cap 100 and the applicator 200. By varying the dimensions of the inner cavity to those of the application part 11 and the neck 12, the penetration of the application part 11 and the neck 12 into the head 2 can be controlled. The applicator 200 is fixed on the container by way of its connection base 13 and can be detached from the container.

Figure 4:
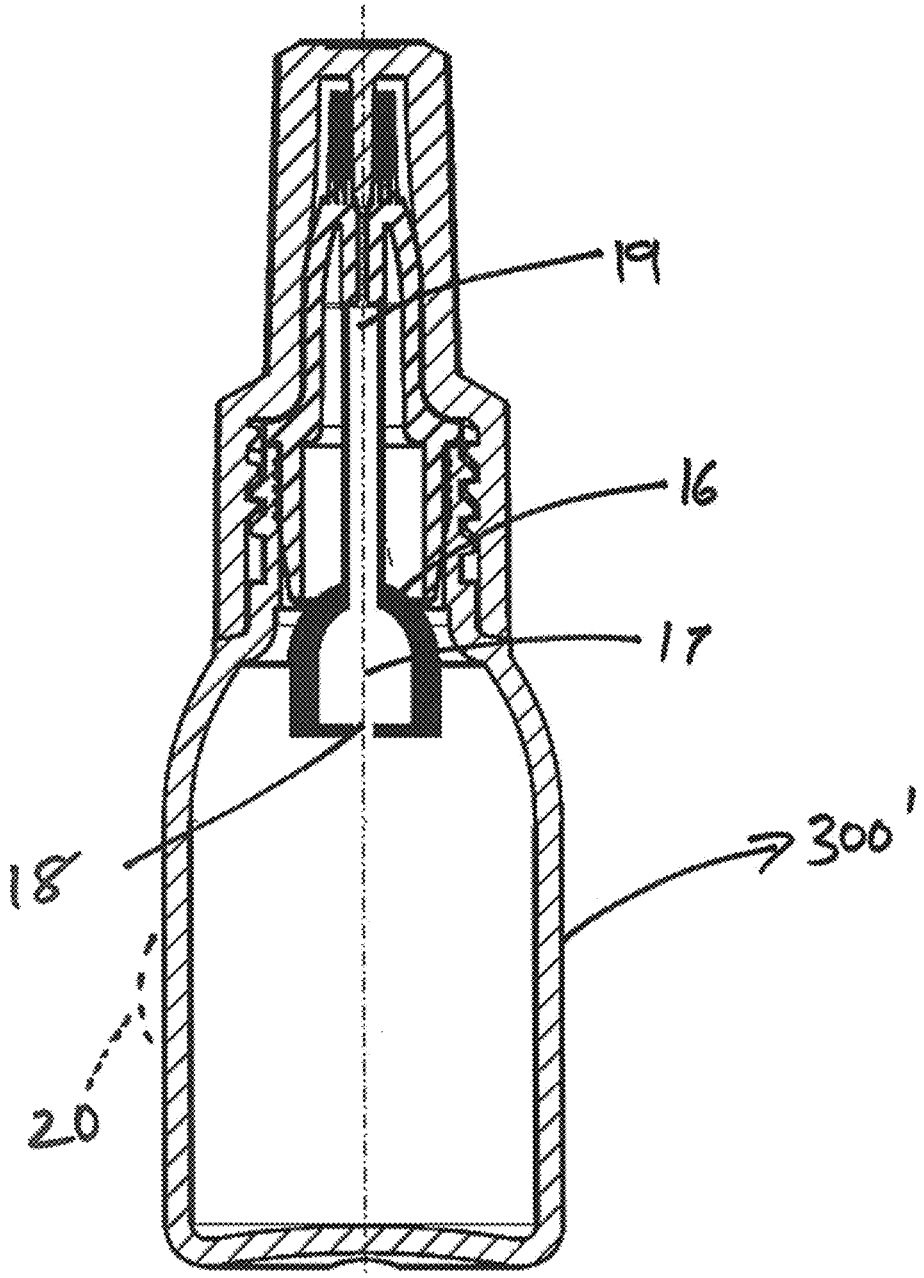
FIG. 4 shows a schematic view of a cross-section of an assembly comprising the metering device, optionally comprising a button.

FIG. 4 shows a cross-sectional view of an upper part of the assembly 300' comprising a metering device 16. The metering device 16 has an inlet 18, an intermediate storage reservoir 17 and an outlet 19. As can be seen from the figure, the outlet 19 of the metering device is connected to the outlet 14 of the applicator 200 (as shown in FIG. 2A). The metering device 16 can be located in any part of the container. The assembly 300' can optionally comprise a button 20 (in dotted lines).

Figure 5A:
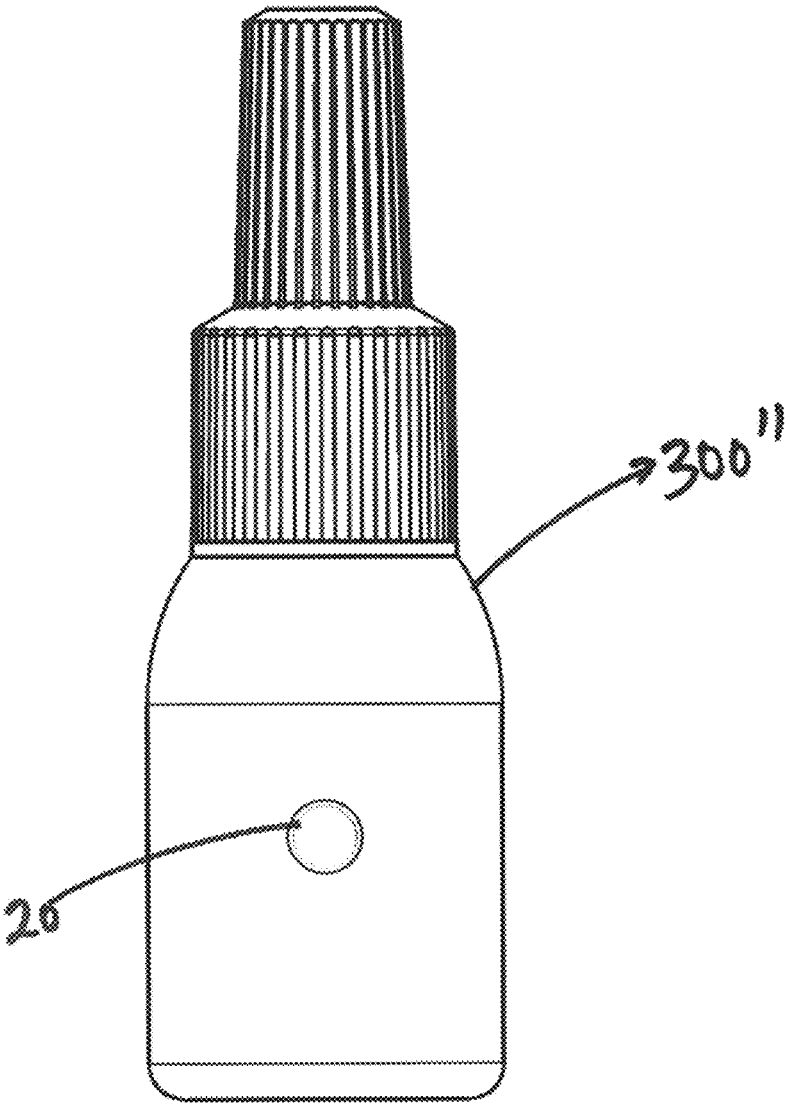
FIG. 5A shows a schematic view of the assembly comprising the button.

FIG. 5A depicts a schematic view of an assembly 300" comprising a cap 100, an applicator 200 (as shown in FIG. 2A), a container 15 and a button 20. In this figure, the button 20 is located on the lateral surface of the container 15.

Figure 5B:
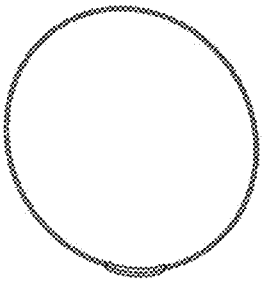
FIG. 5B shows a schematic view of a cross-section of the container at the mid-point of the button.

FIG. 5B shows a cross-sectional top view of the container through the center of the button 20. The button 20 is separate from the container and can be produced together with the container or produced separately and subsequently attached onto the body of the container. The button 20 can be located on any part of the container including its bottom. The button 20 can be circular or polygonal.

Figure 6:
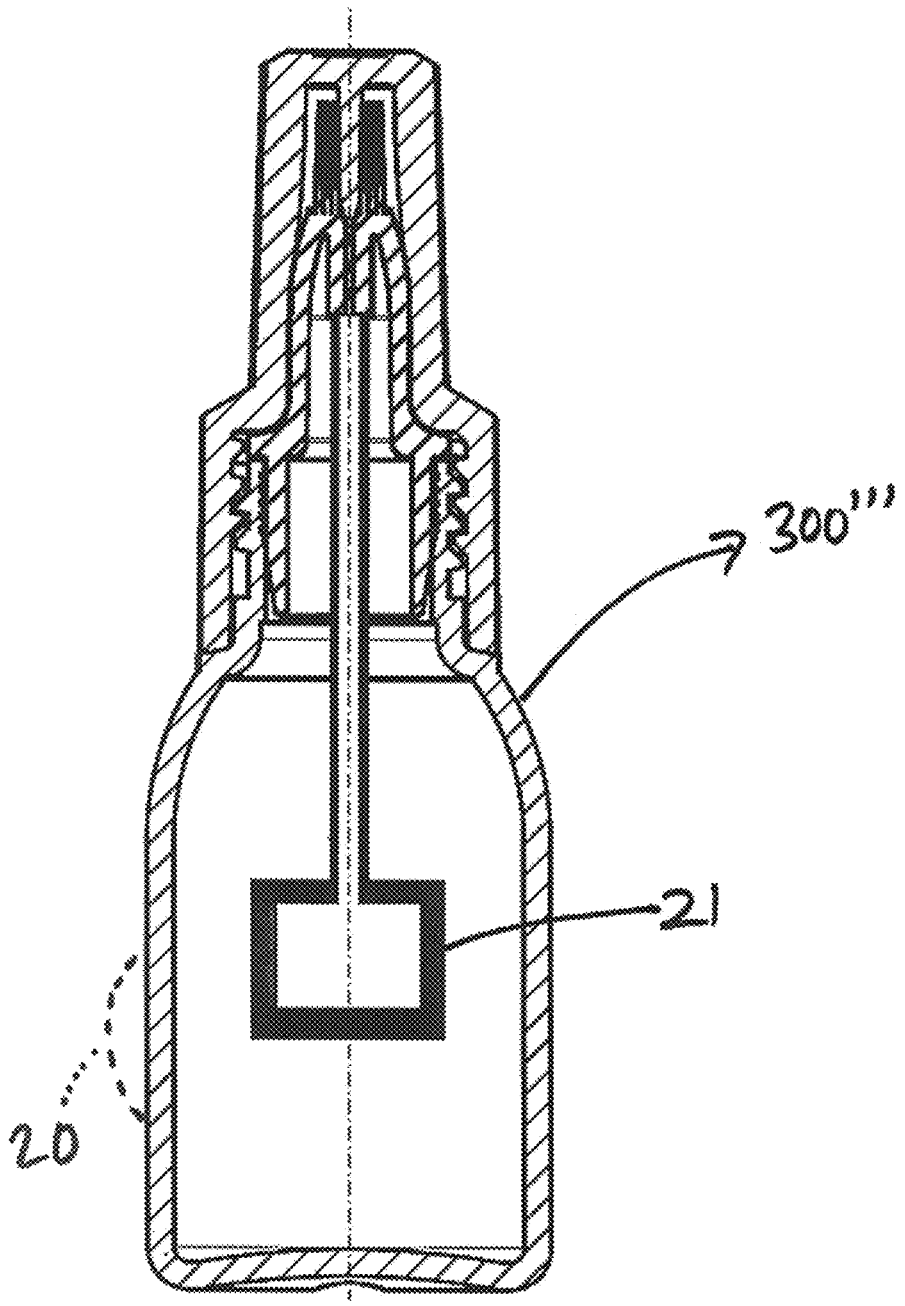
FIG. 6 shows a schematic view of a cross-section of an assembly comprising the sachet, optionally comprising a button.

FIG. 6 shows a cross-sectional view of the assembly 300 according to an embodiment of the present invention comprising a sachet 21. As can be seen from the figure, the outlet of the sachet is connected to the outlet 14 of the applicator 200. The assembly 300 can optionally comprise a button 20 (in dotted lines).

EXAMPLES

Tests were conducted using an applicator and container similar to those in FIGS. 1 to 3. In one case a cap according to the prior art (as disclosed in DE'781) was tested, and in another case a cap according to an embodiment of the present invention (similar to that of FIGS. 1-3) was tested. The condition of the bristle applicator in each case was evaluated after repeated usage. After every 30 cycles of usage (opening and closing of the cap) photographs were taken.

Comparative Example 1

Figure 7A:
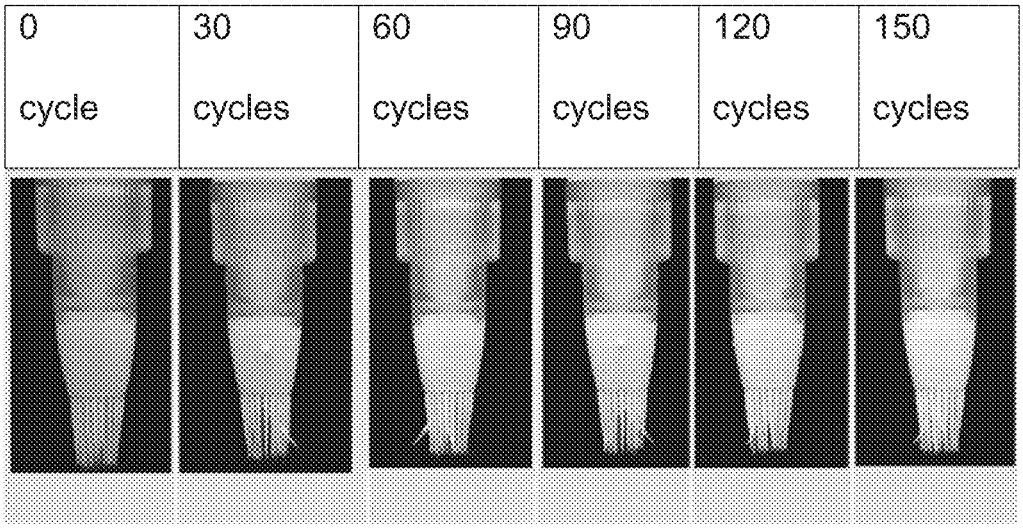
FIG. 7A shows images of bristles of an applicator obtained while testing the opening and closing of a cap according to DE202014104781U1.

As can be seen from the images in FIG. 7A, the cap as disclosed in DE'781 caused deformations in the bristles of the applicator after 30 cycles. By 60 cycles multiple bristles of brush were extensively and irreversibly damaged, for example bent or deformed in shape, by use of the prior art cap.

Working Example 1

Figure 7B:
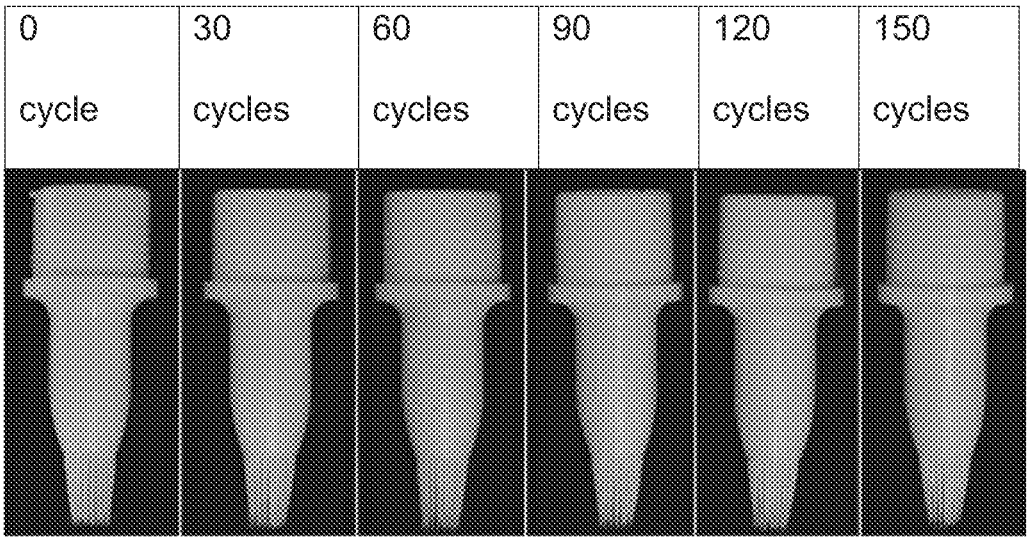
FIG. 7B shows images of bristles of an applicator obtained while testing the opening and closing of a cap according to the present invention.

In contrast, as seen from FIG. 7B the bristles of the applicator were not damaged even after 150 cycles of opening and closing the cap according to this embodiment of the present invention.

These tests demonstrate the superiority of the cap of the present disclosure versus those of the prior art.

What is claimed:

1. A cap comprising:

an inlet;

a base having a connection portion configured to connect the cap to an applicator or a container;

a head configured to receive an application part of the applicator within the head;

a projection disposed at a top part of the cap, the top part is disposed at an opposite end to the inlet and the projection is configured to cooperate with an outlet of the applicator, the head comprising at least one of a cylindrical or conical inner or outer shape, and the connection portion having an inner or outer shape selected from the group consisting of round, oval and square;

an alignment portion configured to align bristles of the applicator, substantially in parallel to a longitudinal axis of the cap; and a fitting portion including an annular groove on an inner surface of the head and configured to enable the applicator to be detachably retained inside the cap, and the head comprising a conical inner shape starting from a top of the cap to the fitting portion with an increasing radius from the top to the fitting portion, a cylindrical shape at the alignment portion, and a smooth curvature at a transition to the base of the cap.

2. The cap according to claim 1, wherein the alignment portion is substantially cylindrical in shape.

3. The cap according to claim 1, wherein a length of the alignment portion is about 20 to about 40% of a length of the head.

4. The cap according claim 1, wherein the fitting portion comprises at least one change in the inner radius of the head.

5. The cap according to claim 4, wherein the at least one change in the inner radius of the head is a reduction of the inner radius of the head.

6. The cap according to claim 5, wherein the reduction of the inner radius of the head is by one or more protrusions or a conical geometry or a change from a larger cylindrical diameter to a smaller cylindrical diameter.

7. The cap according to claim 1, wherein the projection has a tip disposed opposite of the top, the tip having a shape selected from the group consisting of a truncated cone, conical, bulbous and cylindrical.

8. The cap according to claim 1, wherein the projection comprises a body part extending between the top and the tip, the body part having one of a substantially conical, cylindrical, or rectangular shape.

9. The cap according to claim 1, wherein the applicator is a bristle applicator.

10. An assembly comprising:

the cap of claim 1;

an applicator; and a container configured to hold a fluid for application, the applicator comprising a metering device to enable a controlled amount of the fluid contained in the container to flow through the outlet of the applicator, the metering device having an inlet, an intermediate storage reservoir comprising a variable volume to control the amount of fluid leaving the container and an outlet, all in fluid communication with each other, the inlet of the metering device in fluid communication with the container, and the outlet of the metering device in fluid communication with the outlet of the applicator.

11. The assembly of claim 10, wherein the container comprises a button configured to dose the fluid, and the button is disposed on a surface of the container.

12. The assembly of claim 11, wherein the surface is a lateral surface of the container or a bottom of the container.

13. The assembly of claim 10, wherein the fluid is a medication or cosmetic mass.

14. An assembly comprising:

the cap of claim 1;

an applicator; and a container configured to hold a fluid for application comprising a button configured to dose the fluid, and the button located on a surface of the container.

15. The assembly of claim 14, wherein the surface is a lateral surface of the container or a bottom of the container.

16. An assembly comprising:

an applicator;

a container; and the cap of claim 1, the container comprising a sachet, the sachet configured to hold a fluid for application, and the sachet being disposed inside the container and in fluid communication with an outlet of the applicator.

17. The assembly of claim 16, wherein the container comprises a button configured to dose the fluid, and the button is disposed on a surface of the container.

18. An assembly comprising:

an applicator with a connection base and a neck projecting away from the connection base, the neck comprising bristles at a front end of the applicator; and a cap for the applicator, the cap comprising a fitting portion, an inlet, a base having a connection portion configured to connect the cap to the applicator or a container, a head configured to receive an application part of the applicator within the head, and a projection at a top part of the cap, the top part formed at an opposite end to an inlet and the projection configured to cooperate with an outlet of the applicator, the head comprises at least one of a cylindrical or conical inner shape forming an alignment portion beginning in a region at a transition between the head and the base of the cap and configured to centrally align the bristles of the applicator before the bristles reach the projection of the cap, when connecting the cap to the applicator or the container, the fitting portion being an annular groove on an inner surface of the head and configured to enable the applicator to be detachably retained inside the cap, and the connection portion having an inner or outer shape selected from the group consisting of round, oval and square.

* * * * *